US008297361B1

(12) United States Patent
Root

(10) Patent No.: US 8,297,361 B1
(45) Date of Patent: Oct. 30, 2012

(54) SEA BED OIL RECOVERY SYSTEM

(76) Inventor: Warren N. Root, Prescott, AZ (US)

( * ) Notice: Subject to any disclaimer, the term of this patent is extended or adjusted under 35 U.S.C. 154(b) by 0 days.

(21) Appl. No.: 13/046,693

(22) Filed: Mar. 11, 2011

Related U.S. Application Data

(60) Provisional application No. 61/359,566, filed on Jun. 29, 2010, provisional application No. 61/415,835, filed on Nov. 21, 2010.

(51) Int. Cl.
*E21B 43/01* (2006.01)
*E21B 19/00* (2006.01)

(52) U.S. Cl. ..... 166/364; 166/341; 166/344; 166/352; 166/368; 166/75.13; 405/170; 405/184.4; 405/224.2

(58) Field of Classification Search ..... 166/368, 166/338, 339, 341, 344, 350–352, 364, 367, 166/369, 372, 381, 75.13; 405/158, 169, 405/170, 172, 184.4, 184.5, 224.2–224.4; 414/137.5, 137.7, 142.8
See application file for complete search history.

(56) References Cited

U.S. PATENT DOCUMENTS 1,830,061 A * 11/1931 Howe ..... 166/79.1
3,389,559 A * 6/1968 Logan ..... 405/60
3,548,605 A * 12/1970 Armistead et al. ..... 405/60
3,561,220 A * 2/1971 Riester ..... 5/60
3,653,215 A * 4/1972 Crucet ..... 405/60
3,658,181 A * 4/1972 Blair ..... 210/170.05
3,664,136 A * 5/1972 Laval et al. ..... 405/60
3,666,100 A * 5/1972 Madej ..... 210/800
3,667,605 A * 6/1972 Zielinski ..... 210/170.11
3,674,150 A * 7/1972 Lejeune ..... 210/245
3,681,923 A * 8/1972 Hyde ..... 405/60
3,719,048 A * 3/1973 Arne et al. ..... 405/205
3,724,662 A * 4/1973 Ortiz ..... 405/65
3,745,773 A * 7/1973 Cunningham ..... 405/60
3,941,189 A * 3/1976 Peevey ..... 166/364
4,220,207 A * 9/1980 Allen ..... 166/367
4,290,714 A * 9/1981 Strange ..... 405/60
4,317,488 A * 3/1982 Shotbolt ..... 166/351
4,324,505 A * 4/1982 Hammett ..... 405/60
4,336,843 A * 6/1982 Petty ..... 166/353
4,358,218 A * 11/1982 Graham ..... 405/60
4,358,219 A * 11/1982 Burns ..... 405/60
4,376,467 A * 3/1983 Allen ..... 175/7
4,382,716 A * 5/1983 Miller ..... 405/60
4,395,157 A * 7/1983 Cunningham ..... 405/60
4,421,436 A * 12/1983 Burns ..... 405/223.1
4,440,523 A * 4/1984 Milgram et al. ..... 210/170.11
4,449,850 A * 5/1984 Cessou et al. ..... 405/60
4,456,071 A * 6/1984 Milgram ..... 166/356
4,531,860 A * 7/1985 Barnett ..... 405/60

(Continued)

*Primary Examiner* — Matthew Buck
(74) *Attorney, Agent, or Firm* — Jerry Turner Sewell

(57) ABSTRACT

An oil recovery system recovers oil released at the bed of a body of water. The system includes a fluid collector assembly positionable proximate to the bed of the body of water. The collector assembly has an open lower end to receive fluid and has an upper end coupled to a lowermost fluid transfer tube. Fluid transfer tubes are interconnected in a string between the lowermost fluid transfer tube and a vessel positioned to receive fluid transferred through the fluid transfer tube. A guide cable is anchored at the bed of the body of water to guide the fluid collector assembly and the fluid transfer tubes to the bed. A lift cable selectively lowers the fluid collector assembly and the fluid transfer tubes to the bed. Fluid entering the collector assembly rises to the water surface via the transfer tubes.

15 Claims, 11 Drawing Sheets

U.S. PATENT DOCUMENTS 4,533,526 A * 8/1985 Delacour et al. ..... 423/1
4,568,220 A * 2/1986 Hickey ..... 405/60
4,619,762 A * 10/1986 Delacour et al. ..... 210/170.11
4,643,612 A * 2/1987 Bergeron ..... 405/60
4,702,832 A * 10/1987 Renfrow ..... 210/242.3
4,790,936 A * 12/1988 Renfrow ..... 210/242.3
4,962,817 A * 10/1990 Jones et al. ..... 175/5
5,213,444 A * 5/1993 Henning ..... 405/63
5,284,213 A * 2/1994 Nobileau ..... 175/5
5,950,732 A * 9/1999 Agee et al. ..... 166/354
6,192,691 B1 * 2/2001 Nohmura ..... 62/53.1
6,299,256 B1 * 10/2001 Wyatt ..... 299/8
7,197,999 B2 * 4/2007 Murray ..... 114/264
7,546,880 B2 * 6/2009 Zhang et al. ..... 166/358
7,987,903 B1 * 8/2011 Prado Garcia ..... 166/75.13
8,016,030 B1 * 9/2011 Prado Garcia ..... 166/75.13
2011/0293372 A1 * 12/2011 Later ..... 405/60

* cited by examiner

SEA BED OIL RECOVERY SYSTEM

RELATED APPLICATIONS

The present application claims the benefit of priority under 35 USC §119(e) to U.S. Provisional Application No. 61/359,566, filed on Jun. 29, 2010, and to U.S. Provisional Application No. 61/415,835, filed on Nov. 21, 2010.

BACKGROUND OF THE INVENTION

1. Field of the Invention

The present invention is in the field of off-shore oil production, and, more particularly, is in the field systems to recover oil released proximate to the sea bed.

2. Description of the Related Art

Off-shore drilling for oil below the sea bed is an important part of world-wide energy production. For deep-water exploration, a typical off-shore oil drilling system includes a floating platform (or rig) that is anchored (tethered) to the sea bed to secure the platform at a particular location over the sea bed. The well is drilled through a blowout preventer or other structure on the sea bed that is intended to prevent an inadvertent discharge of pressurized oil from the well if an unexpected increase in pressure causes oil to rise in the annular space between the casing and the drill pipe within the casing. Blowout preventers generally operate as intended; however, when a blowout preventer does not work as intended, oil can escape from the well into the water surrounding the well. In some cases, particularly at great depths, the oil may continue to escape for extended periods. For example, the Deepwater Horizon oil spill in the Gulf of Mexico started with an explosion on Apr. 20, 2010, and released oil into the Gulf of Mexico until at least Jul. 15, 2010. During that time, many attempts were made to stop the release by capping the wellhead. In the meantime, many millions of barrels of oil spread throughout the Gulf of Mexico. Although considerable efforts were made to constrain the spread of the oil and to recover part of the oil, the oil spread rapidly and reached the shorelines, thus causing extensive damage to the ocean environment and to the shorelines.

SUMMARY OF THE INVENTION

In view of the approximately 87 days required to cap the Deepwater Horizon wellhead and much more time to clean up only a portion of the released oil, it is clear that a need exists for a system that can respond more quickly to an underwater release of oil so that the released oil can be constrained and recovered until the leaking wellhead is capped or the leakage is otherwise stopped. Such a system will prevent the spread of the released oil and will also allow the oil to be recovered and possibly transported to a location where the oil can be stored and eventually used to recovery at least a portion of the oil's economic value.

An aspect of embodiments in accordance with the present invention is a sea bed oil recovery system that provides maximum protection to the environment by recovering offshore oil at the sea bed caused by a catastrophic failure during drilling or caused by a natural oil seep.

The system disclosed herein can be rapidly deployed at depths of several 100 feet to over three miles with extreme accuracy. The system can recover over 1,000,000 barrels of oil per day while operating in a collapsed debris field surrounding a wellhead. The system operates from a surface vessel, which is accurately positioned with a global positioning system (GPS) unit. The system is lowered from the surface vessel along a guide cable anchored at the exact work site where the leaking oil is being released. The guide cable guides the underwater components of the system to the leakage site at the sea bed. The system can be raised and lowered quickly with a second cable as required. The system can also used to collect oil from more than one leak simultaneously in a given area. The system will continue to work even if the released material includes a mixture of ice crystals, gaseous materials and oil. The capacity of the system for recovering oil is advantageously up to 2,000,000 barrels per day. The system can operate at depths over 3 miles because the total system weight can be offset by kerosene or any liquid with a lighter specific gravity than water which provides a flotation balance as an integral part of the transfer tube.

BRIEF DESCRIPTION OF THE DRAWINGS

Embodiments in accordance with aspects of the present invention are described below in connection with the attached drawings in which.

DETAILED DESCRIPTION OF PREFERRED EMBODIMENTS

The sea bed oil recovery system is disclosed herein with respect to exemplary embodiments. The embodiments are disclosed for illustration of the sea bed oil recovery system and are not limiting except as defined in the appended claims. Although described herein with respect to the recovery of oil, it should be understood that the system may also be used to recover gas or a mixture of oil and gas.

Figure 1:
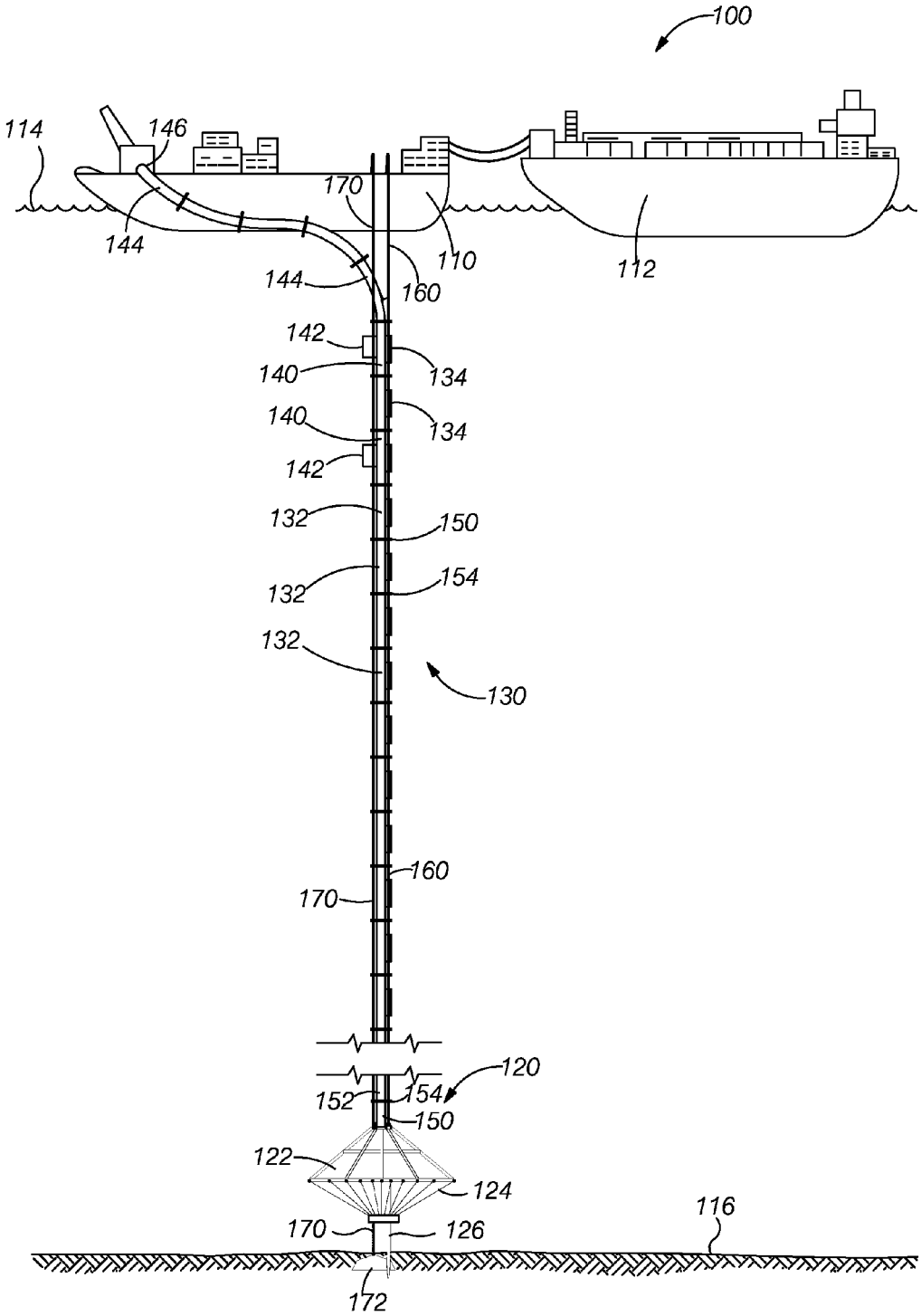
FIG. 1 illustrates a schematic representation of a sea bed oil recovery system in accordance with embodiments of the invention.

FIG. 1 illustrates a schematic elevational view of a sea bed oil recovery system 100 in accordance with one embodiment. The system includes a surface recovery vessel 110 and a shuttle tanker 112 which float on the ocean surface 114 above the sea bed 116.

A collector assembly 120 is positioned proximate the sea bed. The collector assembly comprises an upper cone portion 122 having a continuous outer shell that has the general appearance of an inverted funnel. Although the upper portion of the collector assembly is described herein as a cone, it is understood that the term is used to mean an inverted funnel-like shape. In particular, the illustrated embodiment is described in more detail below as having a shape formed by an octagonal base and an octagonal truncated top portion.

The collector assembly 120 further comprises a mesh-like lower portion 124 (described in more detail below) that operates as a sieve or filter to block debris from entering the upper cone portion 122.

The collector assembly 120 further includes a cylindrical rod 126 that extends through an upper wall 128 (shown in FIG. 6) of the upper cone portion 122 and that extends below the mesh-like lower portion 126. The upper wall is connected to the upper wall. The upper wall is sealed around the cylindrical rod to prevent leakage from the upper cone portion. The cylindrical rod preferably has a tapered lower end. The cylindrical wall preferably comprises a heavy metal core so that a lower portion of the cylindrical rod penetrates the sea bed and assists in maintaining the collector assembly in a fixed location with respect to the sea bed. In particular, the collector assembly is placed over an area of an oil leak or a gas leak at the sea bed to collect leaking oil. Accordingly, the cylindrical rod functions as a positioning device to maintain a lateral position of the collector assembly with respect to the bed of the body of water.

The collector assembly 120 is coupled to the surface recovery vessel 110 via an oil transfer tube string 130 comprising a plurality of passive oil transfer tube sections 132. In an illustrated embodiment, each oil transfer tube section includes an attached buoyancy tank 134 to reduce the overall weight of the oil transfer tube string, as discussed below. The oil transfer tube string may further include a plurality of active oil transfer tube sections 140 with an integral pump 142. The active oil transfer tube sections may include the attached buoyancy tanks.

As illustrated in FIG. 1, a first plurality of transfer tube sections 144 (e.g., approximately 20 sections (only 5 sections are illustrated in FIG. 1)) comprise flexible material to allow the first plurality of tube sections to translate from a generally horizontal inlet port 146 on the surface recovery vessel 110 to the generally vertical string of transfer tube sections. Additional non-flexible transfer tube sections 132, 140 are added to the top of the vertical string until the collector assembly 120 reaches the sea bed 116 with the lower cone portion 124 of the collector assembly positioned a selected distance above the sea bed. The flexible transfer tube sections are then coupled to the topmost vertical transfer tube section to complete the interconnection from the collector tube assembly to the surface recovery vessel. The flexible tube sections reduce or eliminate damage to the system from any wave action that causes the surface recovery vessel to move with respect to the vertical string of transfer tubes. In the illustrated embodiment, as the vertical string of transfer tubes is being assembled, the uppermost transfer tube of the vertical string of transfer tubes is exposed at the surface so that an additional transfer tube may be added to the top of the vertical string without personnel having to enter the water.

Figure 2:
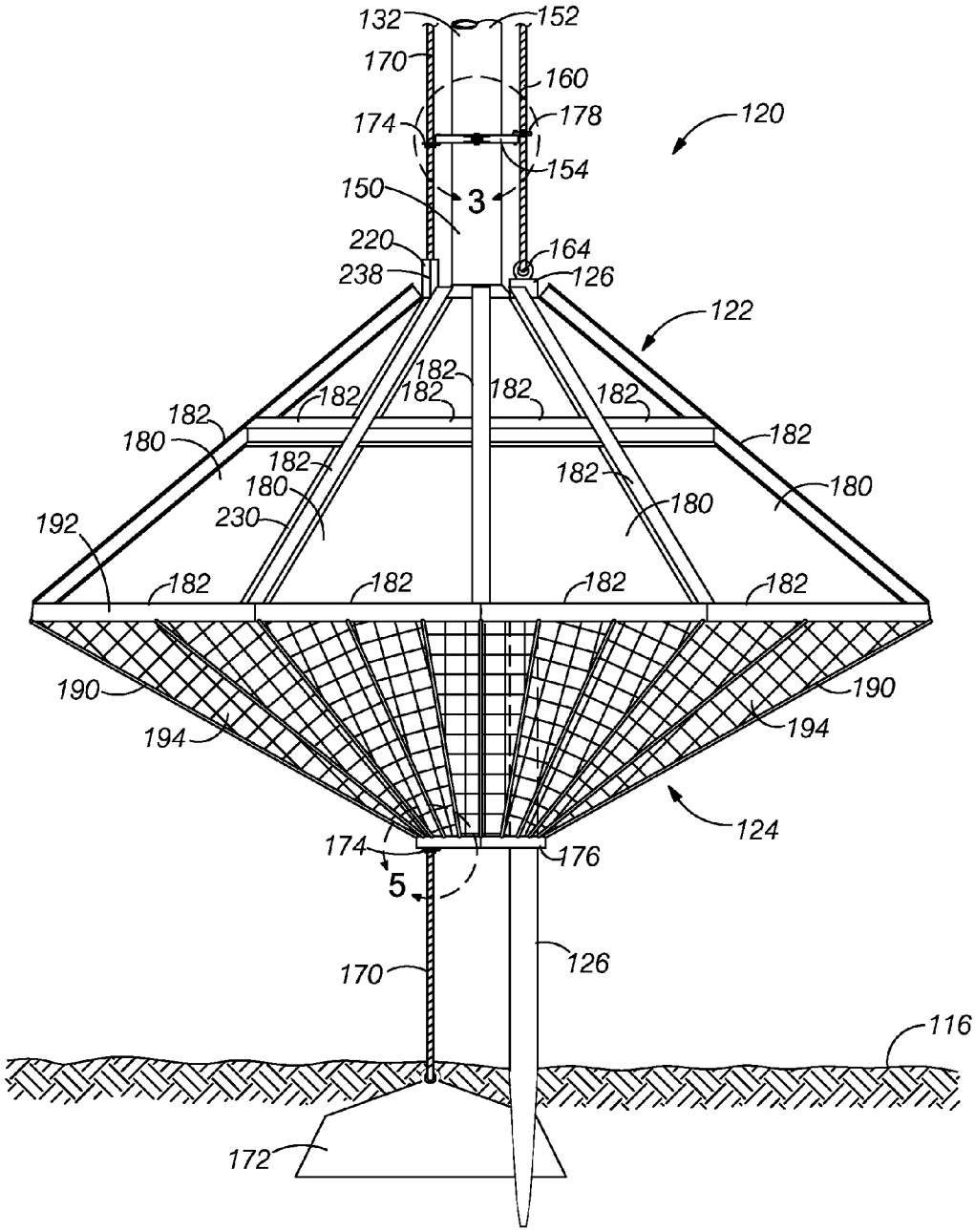
FIG. 2 illustrates an enlarged elevational view of the collector assembly of FIG. 1.

A lowermost oil transfer tube section 150 is coupled directly to the upper wall 128 (FIG. 6) of the upper cone portion 122 of the collector assembly 120. The upper wall has an opening (not shown) that communicates with the cylindrical transfer tube. The lowermost transfer tube section may be permanently welded to the upper cone portion or may be removably attached to the upper cone portion in a conventional manner. The lowermost transfer tube section provides a base for the transfer tube string 130. In particular, the lowermost transfer tube section is coupled to a next lowermost transfer tube section 152 via a coupling system 154. The next lowermost transfer tube section may be a passive transfer tube section 132 (as illustrated in FIGS. 1 and 2) or may be an active transfer tube section 140. Adjacent oil transfer tube sections are coupled together via respective coupling systems as shown in FIG. 1 to create the continuous tube string from the collector assembly to the surface recovery vessel.

The collector assembly 120 and the oil transfer tube string 130 are lowered to and raised from the sea bed by a lift cable 160. As illustrated in FIG. 2, for example, the lift cable terminates in a coupling loop 164 at the top of the cylindrical rod 126. Since the cylindrical rod is connected directly to the upper portion 122 of the collector assembly, the weight of the collector assembly is transferred to the lift cable via the cylindrical rod and the coupling loop.

In the illustrated embodiment, each transfer tube section 132, 134 of the oil transfer tube string is connected to the lift cable 160 via a clamp 166, which is part of the respective coupling system 154 associated with the transfer tube section.

The lift cable is automatically adjusted to maintain the necessary slack between the seabed and the surface recovery vessel to offset the effects of wave motion during an oil recovery operation. The plurality of flexible transfer tube sections 144 are not connected to the lift cable and allow the surface recovery vessel to move with respect to the top of the vertical transfer tube string.

The collector assembly 120 and the oil transfer tube string 130 are guided to the area of the leakage at the sea bed by a traverse guide cable 170. The traverse guide cable is anchored to the sea bed by an anchor 172, which comprises a large weight, a vacuum column anchor or other suitable anchor. The traverse guide cable is coupled to the collector assembly and to the oil transfer tube string by a plurality of roller guide assemblies 174, which include a respective roller guide assembly associated with each of the coupling systems 154 between the transfer tube sections 132, 140, 150 (FIGS. 2-4) and which include a roller guide assembly connected to a support ring 176 at the bottom of the lower cone portion 124 (FIGS. 2 and 5). The plurality of flexible tube sections 144 are not coupled to the traverse guide cable 170. The lift cable is connected to each coupling system via a cable guide ring 178. The coupling system, the roller guide assembly and the cable guide ring are described in more detail below.

FIGS. 2-9 illustrate the collector assembly 120 in more detail. The bottom of the upper cone portion 122 of the collector assembly has a selected radius. For example, the radius may be selected to be in a range from 20 feet to 100 feet. The upper cone portion of the collector assembly comprises a plurality of segments 180 formed into the continuous outer shell of a cone. As discussed above, the term cone is used to designate the inverted funnel-like shape of the upper portion of the collector assembly. The upper cone portion of the collector assembly may have as few as six segments and may have sixteen segments, or more, depending on structural requirements. For example, in the illustrated embodiment, the upper cone portion of the collector assembly comprises eight segments. The upper cone portion operates as an inverted funnel (e.g., the larger diameter of the funnel is at the bottom) that is positioned over the area of the oil leak. The upper cone portion has an external structure comprising a plurality of I-beams 182. The internal structure maintains the shape of the cone while allowing the inner surface of the cone in contact with the oil to be smooth and unobstructed.

As further shown in FIG. 2, the lower portion 124 of the collector assembly 120 comprises a plurality of cable spokes 190 that extend from the lower support ring 176 to an upper support ring 192 that forms the lower circumference of the upper conical portion 122. Although described herein as rings, the lower support ring and the upper support ring may be other shapes. For example, the upper support ring advantageously comprises a plurality of the I-beams 180 that are interconnected to form the lower circumference of the upper conical portion. The cable spokes provide a support structure for a woven cable mesh 194 that completely covers the area between the cylindrical rod and the upper conical portion of the collector assembly. The mesh has a mesh size determined by the viscous nature and or particle mass of the material (e.g., the oil) being recovered from sea bed leak site. More particularly, the mesh size is selected to be sufficiently small to prevent fish and floating debris in the vicinity of the oil leak from entering the collector and passing into the transfer tube. Any area between the lower ring and the cylindrical rod may be covered with mesh or a solid material to prevent debris from entering the lower cone portion.

Figure 6:
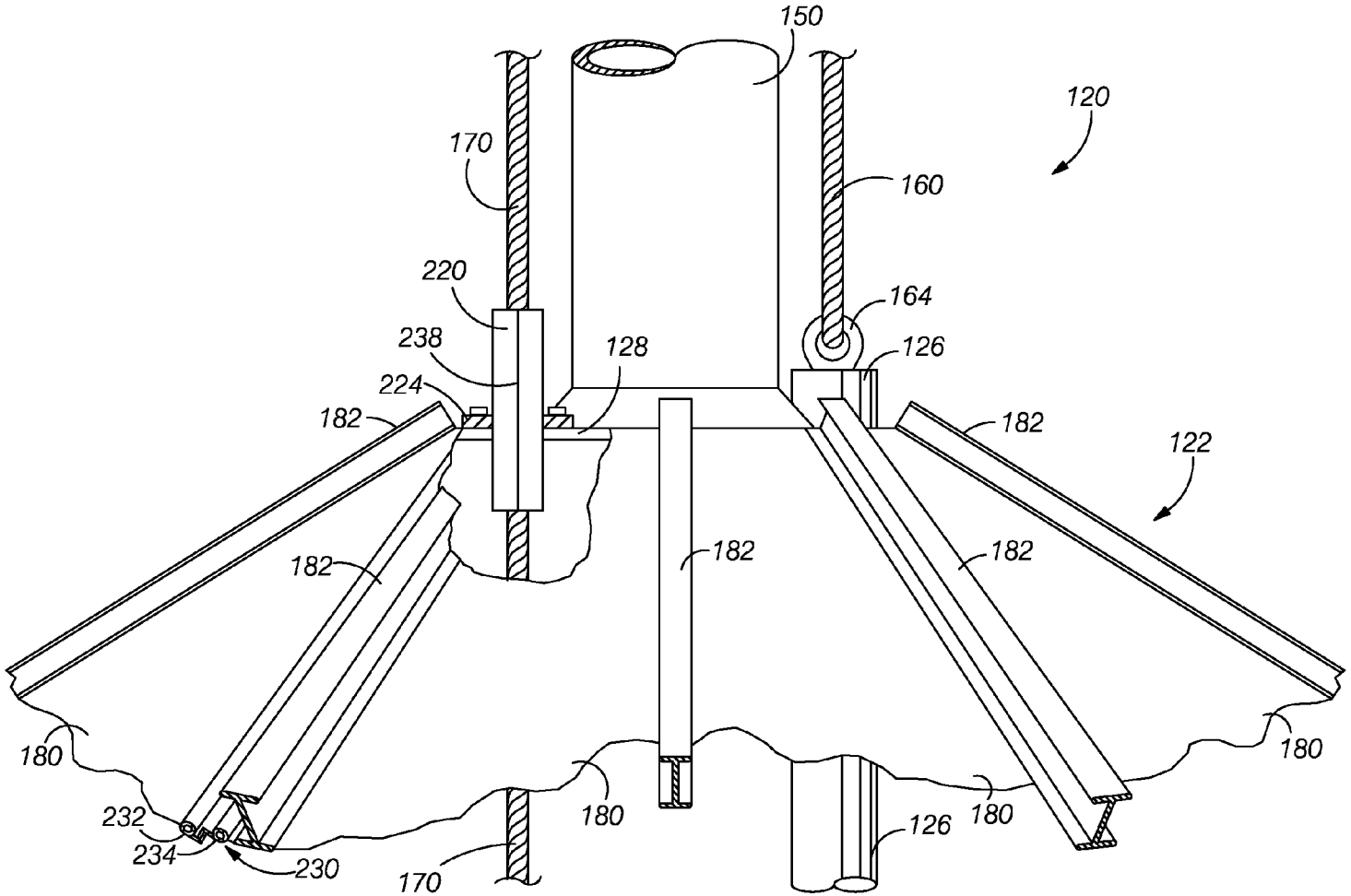
FIG. 6 illustrates a partially broken elevational view of the upper portion of the collector assembly of FIG. 2 showing an access slot that opens to allow a traverse guide cable to be inserted into a split packing housing.

FIG. 6 illustrates an enlarged section of the upper portion 122 of the collector assembly 120 with a portion of one of the segments 180 broken away to show a split packing housing 220 which receives the traverse guide cable 170. The split packing housing penetrates the upper wall 128 of the upper cone portion of the collector assembly. The split packing housing is secured to the upper wall by a bracket assembly 224. The inside of the split packing housing is filled with a packing material that provides a leak-resistant seal around the traverse guide cable so that oil collected within the collector assembly does not leak out of the upper portion of the collector assembly. The packing material allows the traverse guide cable to slide easily through the split packing housing as the collector assembly is raised and lowered by the lift cable 160.

Figures 7, 8, 9:
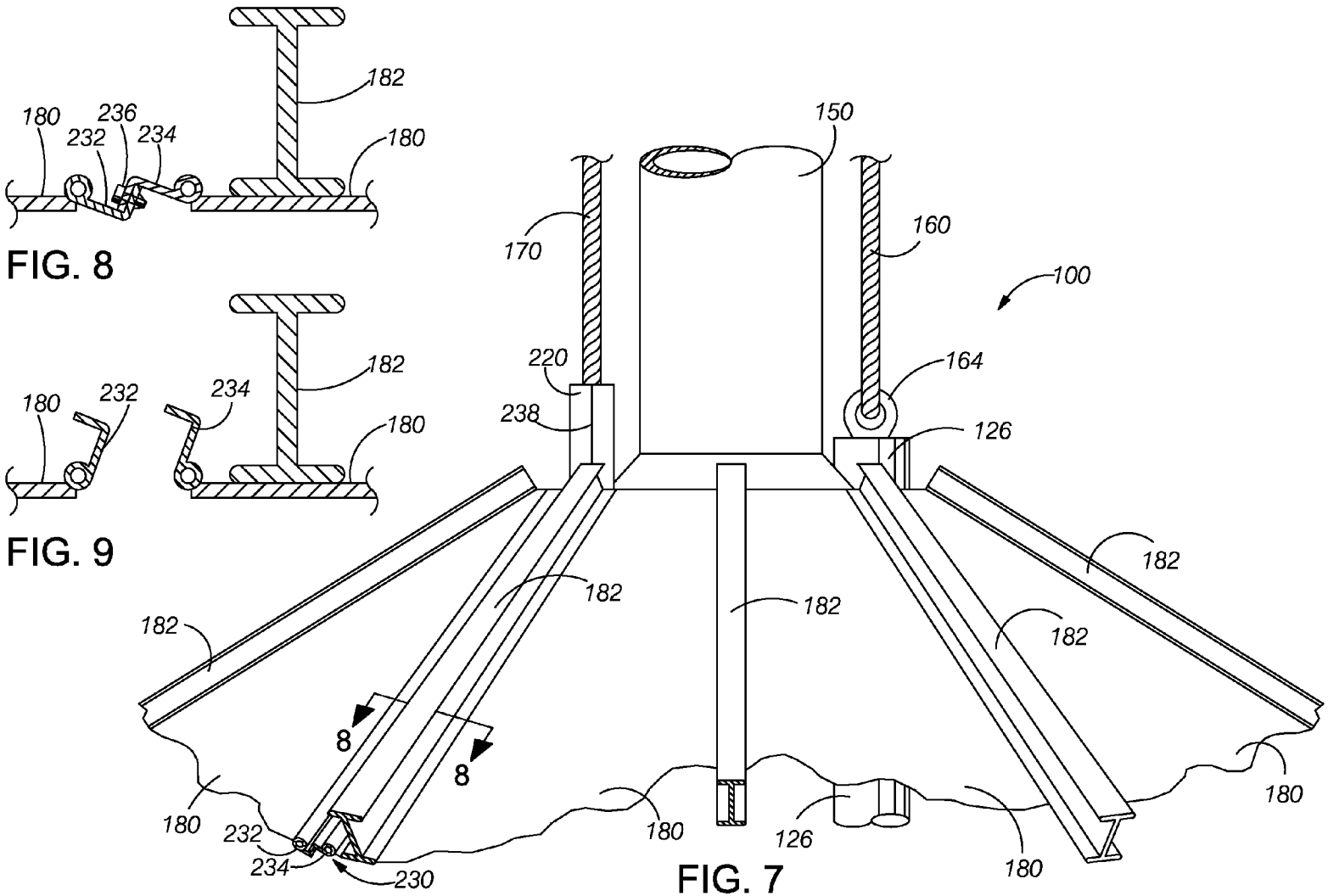
FIG. 7 illustrates an elevational view of the upper portion of the collector assembly of FIG. 2 showing the relationship between the access slot and the split packing housing.
FIG. 8 illustrates a cross-sectional view taken along the line 8-8 in FIG. 7 with the access slot closed with two interlocking channels engaged and secured with a locking pin.
FIG. 9 illustrates the cross-sectional view of FIG. 8 with the locking pin removed and the interlocking channels of the access slot opened to allow the traverse guide cable to pass through the access slot.

The traverse guide cable 170 is lowered to the sea bed 116 and anchored via the anchor 172 before lowering the collector assembly 120 along the traverse guide cable. Since the collector assembly is coupled to the traverse guide cable, the upper portion 122 of the collector assembly includes an access slot 230 proximate to one of the I-beams 182. As shown in the enlarged cross section in FIG. 8, the access slot comprises two interlocking channels 232, 234 which are normally closed by engaging the two channels and securing the two channels in the interlocked position with at least one interlocking pin 236 (described below). As shown in FIG. 9, the two channels are opened by removing the interlocking pin and rotating the two channels from the interlocked position to allow the traverse guide cable to pass between the two channels and be positioned in the split packing housing 220 via a sealable seam 238 in the split packing housing. Thereafter, the two interlocking channels are engaged and secured with the locking pin to close the access slot and restore the continuity of the inner surface of the upper portion of the collector assembly. The I-beams 180 that cross the access slot, as shown in FIG. 2, are removed when coupling the collector assembly to the traverse guide cable and are attached before lowering the collector assembly into the water and attaching the transfer tube string 130.

Figure 3:
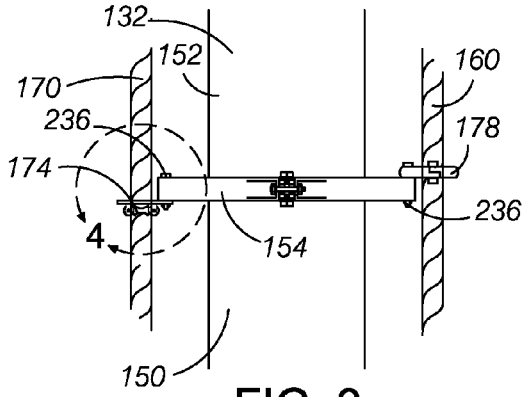
FIG. 3 illustrates an enlarged view of the flange clamp, cable guide ring and roller guide assembly taken in the area—3—of FIG. 2.
Figure 4:
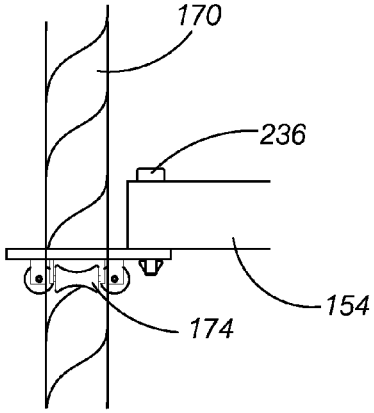
FIG. 4 illustrates an enlarged view of the roller guide assembly taken in the area—4—of FIG. 3.
Figure 5:
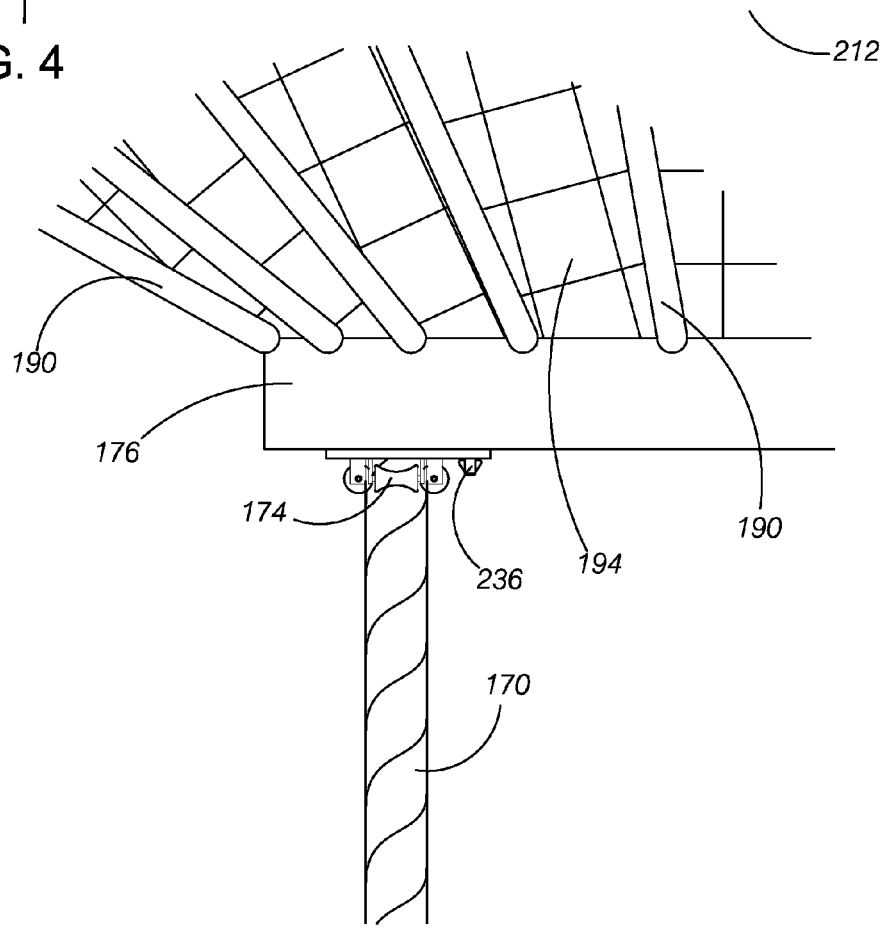
FIG. 5 illustrates an enlarged view of the lower roller guide assembly taken in the area—5—of FIG. 2.

As further illustrated in FIGS. 2-4, the lowermost transfer tube section 150 is coupled to the next lowermost transfer tube section 152 with the coupling system 154. In the illustrated embodiment, the coupling system is a tube joint lock ring clamp, which clamps two adjacent flanges (described below) together. The tube joint lock ring clamp is connected to the roller guide assembly 174 via a locking pin 236. The roller guide assembly receives the traverse guide cable 170. The traverse guide cable then passes through the split packing housing 220 and passes through the roller guide assembly on the lower ring 176 and then to the sea anchor 172. Accordingly, with the traverse guide cable maintained in a vertical position by tension applied by the surface support vessel 110, the collector assembly is maintained in the substantially vertical orientation shown in the drawings. Corresponding roller guide assemblies connected to the coupling systems of adjacent transfer tube sections of the transfer tube string guide the transfer tube sections as the transfer tube string and the collector tube assembly is raised and lowered and maintain the transfer tube string in a substantially vertical orientation after the collector tube assembly is positioned proximate to the sea bed 116.

As shown in FIGS. 2 and 3, the coupling system (tube joint lock ring clamp) 154 is also connected to a cable guide ring 178 via a locking pin 236. When the cable guide ring is secured to the lift cable 160, the associated transfer tubes 130, 132, 150 are coupled loosely to the lift cable so that each transfer tube is maintained in a substantially vertical position between the traverse guide cable 170 and the lift cable.

Figure 10:
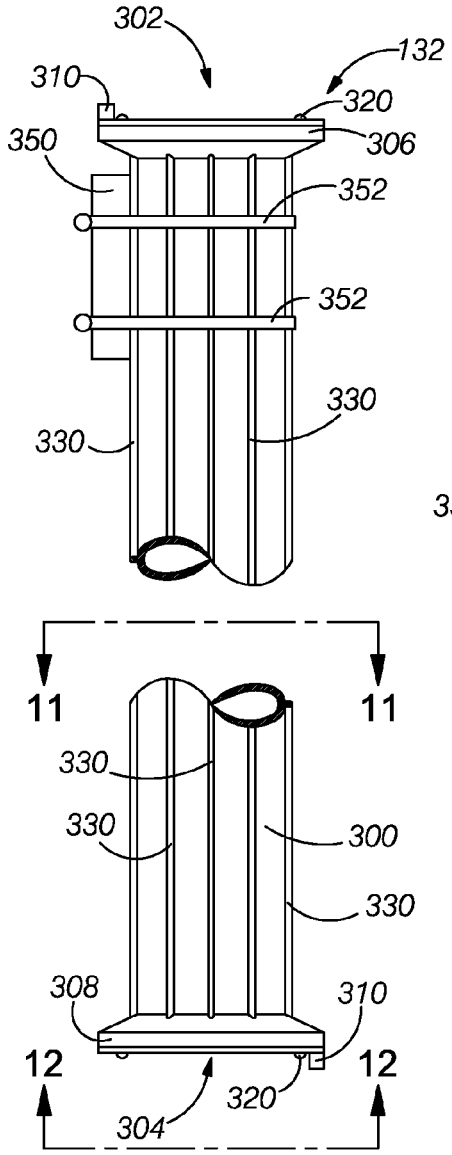
FIG. 10 illustrates a partially broken elevational view of an oil transfer tube section.

FIG. 10 illustrates an elevational view of an embodiment of the passive transfer tube section 132. The tube section is shown in a cross-sectional view in FIG. 11 and in a lower end view in FIG. 12. As illustrated, the transfer tube section comprises a generally cylindrical tube portion 300 having an open upper end 302 and an open lower end 304. The upper end is surrounded by an upper flange 306. The lower end is surrounded by a lower flange 308. Each flange has a respective alignment pin 310 that protrudes perpendicular to the plane of the flange and has a respective alignment notch 312. The configurations of the two flanges are mirrored such that when adjacent upper and lower tube sections are connected, the pin on the upper flange of a lower tube section engages the notch on the lower flange of an upper tube section, and the pin on the lower flange of the upper tube section engages the notch on the flange of the lower tube section. As shown in the lower end view in FIG. 12, the opening at the end of the tube section is surrounded by an elastomer gasket 320, such as an O-ring, or by another suitable gasket material, which is compressed when the adjacent flanges are coupled together by the coupling system 154 to provide a leak-proof seal between adjacent transfer tube sections.

In one embodiment, each transfer tube section 130 has a length of approximately 50 feet; however, the length may be varied in accordance with considerations such as ease of handling manufacturability, the number of coupling system required or the like. The cylindrical tube portion 300 has a plurality of linear structural ribs 330 that are secured to the outer wall of the cylindrical tube. The tube may comprise metal or plastic. The transfer tube sections have a sufficiently large inside diameter (e.g., 6 inches to 24 inches) that oil is transferred from the sea bed 116 to the surface recovery vessel 110 with a high flow at a low pressure. The inside diameter is selected as required by the quantity of the leaking oil or leaking to be transferred. When the sea bed oil recovery system 100 is lowered to the leakage site, the collector assembly is open to allow sea water to enter the collector assembly and the transfer tube, thus equalizing the pressure between the inside and the outside of each transfer tube section regardless of the depth of each transfer tube section. Accordingly, the transfer tube wall thickness does not have to vary in accordance with depth. The linear structural ribs are included to maintain the physical structure of each transfer tube section with respect to stresses caused by movement of the system, but do not have to be sized as a function of pressure.

Figure 11:
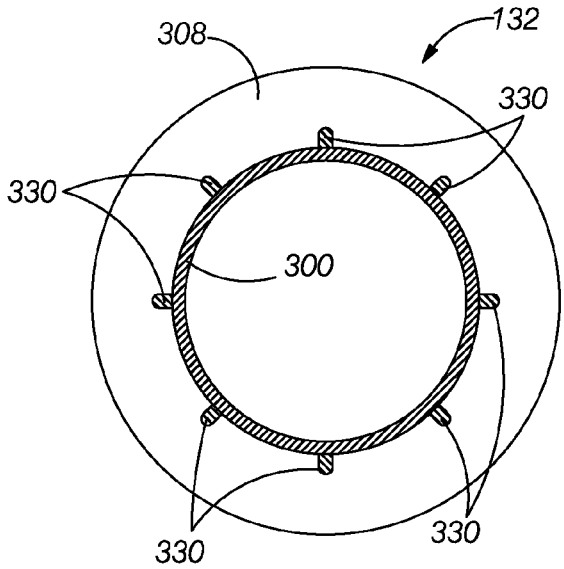
FIG. 11 illustrates a cross-sectional view of the oil transfer tube section of FIG. 10 taken along the line 11-11 in FIG. 10.
Figure 12:
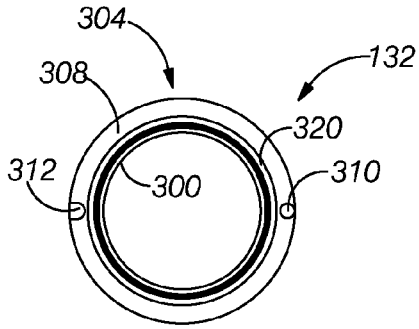
FIG. 12 illustrates a lower end plan view of the oil transfer tube section of FIG. 10 taken in the direction of the arrows 12-12 in FIG. 10.

In the embodiment illustrated in FIG. 11, the weight of the transfer tube section 132 is balanced with an external buoyancy tank 350. The buoyancy tank is held in place along the outer wall 300 of the tube section with straps 352. Alternatively, the flotation tank may be secured to the tube section by bolts or other suitable fastening devices.

In the illustrated embodiment, the buoyancy tank 350 is filled with kerosene or other substantially uncompressible liquid having a specific gravity less than saltwater or fresh water. In an alternative embodiment (not shown), the oil transfer tube section may be constructed as double wall transfer tube section, which is filled with kerosene or other suitable liquid, to create a given buoyancy or weight balance when the transfer tube is submerged. The volume of liquid (e.g., kerosene) used in the buoyancy tank of the transfer tube section (or in double wall of the alternative embodiment) is determined by the weight of the transfer tube section without the buoyancy tank and the desired weight to be offset by the buoyancy of the buoyancy tank. The desired weight to be offset is determined in part by the overall length of the transfer tube string 130 and the lifting capability of the lift cable 160 and the surface support vessel 110. For example, in one embodiment, the volume of the flotation tank is selected to provide a sufficient amount of buoyancy so that each tube section has an effective weight of a few pounds. The buoyancy provided thus reduces the total transfer tube weight when the system is submerged. By reducing the effective weight of each section to a few pounds, the total weight of several thousand feet (e.g., 10,000-15,000 feet) of transfer tube may be reduced to several thousand pounds when submerged.

Figure 13:
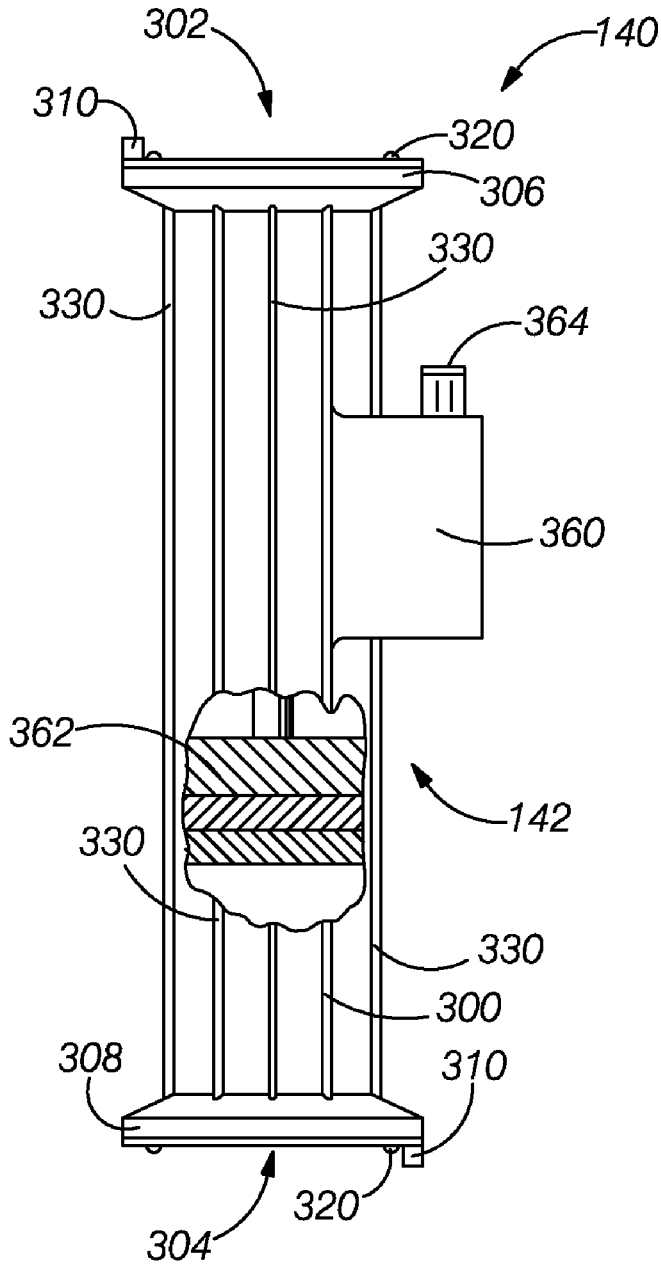
FIG. 13 illustrates an elevational view of another embodiment of the oil transfer tube section which is partially broken to show the impeller portion of an integral motor-driven turbine vane pump.

FIG. 13 illustrates an embodiment of an active transfer tube section 140 that includes the integral turbine vane pump 142. The general structure of the active transfer tube is similar to the structure of the passive transfer tube 132 in FIGS. 10-12, and the common elements are numbered accordingly. An external drive motor 360 is connected to the impeller 362 of a turbine vane pump positioned within the transfer tube section. The speed of the motor is adjusted to maintain the flow of the oil at a constant rate from the sea bed 116 to the oil recovery vessel 110. The transfer tubes with the integral turbine vane pumps are advantageously positionable at locations along the string of tube sections between the sea bed 116 and the surface 114. An electrical or hydraulic power connection 364 is provided to each drive motor in accordance with the type of drive motor. The pump is used only as needed to move the necessary volume of oil as required. Although not shown in FIG. 13, the active transfer tube section may include a buoyancy tank. The buoyancy tank may have a size selected to partially offset the weight of the transfer tube section and the additional weight of the pump.

Figure 14:
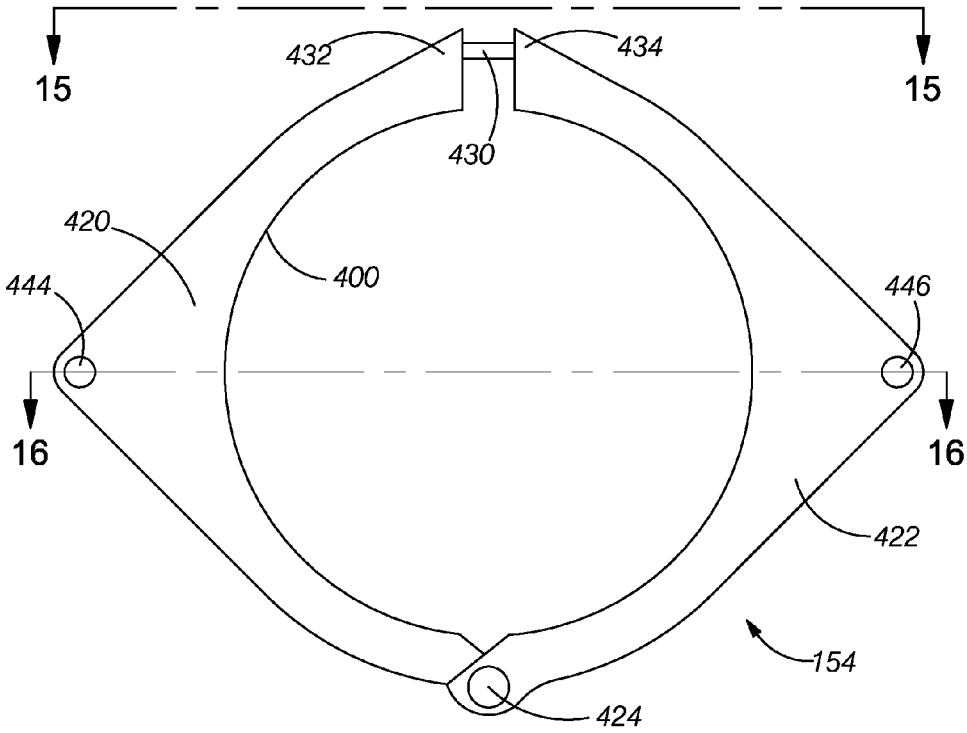
FIG. 14 illustrates a plan view of a tube section joint lock ring clamp that interconnects adjacent oil transfer tube sections.
Figure 15:
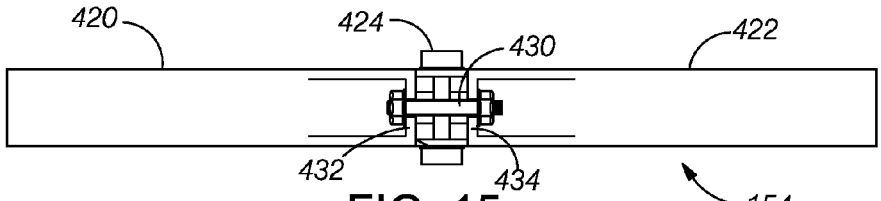
FIG. 15 illustrates an elevational view of the tube section joint lock ring clamp of FIG. 14 taken in the direction of the arrows 15-15 in FIG. 14.
Figure 16:
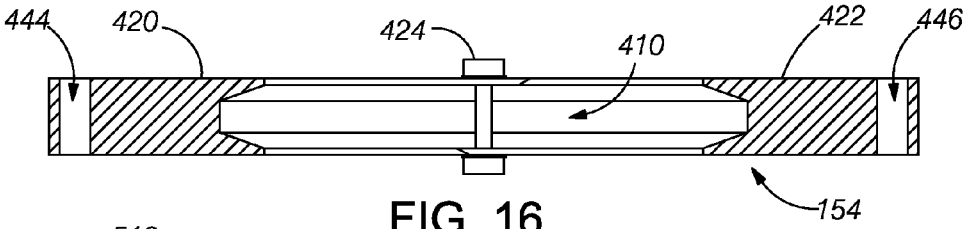
FIG. 16 illustrates a cross-sectional view of the tube section joint lock ring clamp of FIG. 14 taken along the line 16-16 of FIG. 14.

FIGS. 14-16 illustrate a coupling system (tube joint lock ring clamp) 154 used to seal the transfer tubes 130, 132, 150. The ring clamp has an inner circumference 400 having an inner diameter that is sized to accommodate the cylindrical outer wall 300 of a transfer tube. As shown in the cross-sectional view in FIG. 16, a recess 410 is formed in the inner circumference with a shape and a depth selected to accommodate the upper flange 302 and lower flange 304 of adjacent transfer tube sections. In particular, the recess is tapered so that as the ring clamp is tightened, the adjacent flanges are forced together to compress the gasket 320 and effect a secure, leak-proof seal. The ring clamp is formed as a first arcuate section 420 and a second arcuate section 422 hinged at a pivot pin 424. As shown in FIG. 15, the two arcuate sections are joined by a compression bolt 430 positioned between two ears 432, 434. After positioning the two arcuate sections around the flanges, the compression bolt is inserted into slots or bores in each ear and then tightened to force the two ears together to force the adjacent flanges together. Other tightening systems may also be used. For example, in certain embodiments, an over center locking clamp (not shown) is installed on the ring clamp to provide a faster clamping procedure.

As further illustrated in FIGS. 14 and 16, the coupling system (tube joint lock ring clamp) 154 includes diametrically opposed first and second wing portions 440, 442 having a respective first bore 444 and a respective second bore 446 formed therein to receive the locking pins 236. For example, the first bore is positioned to secure the roller guide assembly 174 to the coupling system as described above in connection with FIG. 4; and the second bore is positioned to secure the cable guide ring 178 to the coupling system as described above in connection with FIG. 3. In the illustrated embodiment, the two bores have substantially the same size to receive correspondingly sized locking pins; however, the two bores may have different diameters in alternative embodiments.

Figure 17:
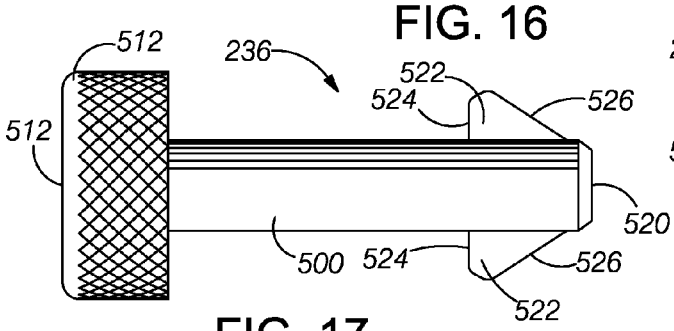
FIG. 17 illustrates an elevational view of a locking pin used in combination with the tube section joint lock ring clamp, the cable guide ring and the roller guide assembly.
Figure 18:
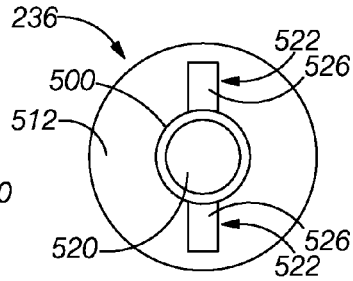
FIG. 18 illustrates an end view of the locking pin of FIG. 17.

FIGS. 17 and 18 illustrate an exemplary embodiment of a locking pin 236 used to interconnect the coupling system (tube joint lock ring clamp) 154, the roller guide assembly 174 and the cable guide ring 178. The locking pin comprises a shaft 500 generally configured as a cylindrical rod. A first end 510 of the shaft terminates at an enlarged head portion 512, which may be knurled as shown in FIG. 17. A second end 520 of the shaft has a first and second barbs 522 extending outwardly as shown. The barbs are generally triangularly shaped with a respective first edge 524 positioned away from the second end and extending generally perpendicularly outward from the shaft. A slanted second edge slopes from the first edge toward the second end of the shaft. The barbs are pivoted proximate the second end of the shaft so that the first edges of the barbs may be pushed into the shaft. Accordingly, when the locking pin is pushed into a respective bore of the coupling system, the roller guide assembly or the cable guide ring, the barbs recess into the shaft to allow the locking pin to pass through the bore. The barbs then expand outwardly so that the respective first edges prevent the locking pin from being removed from the bore unless the barbs are manually caused to recess into the shaft. The diameter of each locking pin is selected to conform to the diameter of the bores into which the locking pin is to be inserted; and the length of each locking pin is selected to conform to the overall length of the bores of the structures to be interconnected with the locking pin.

Figure 19:
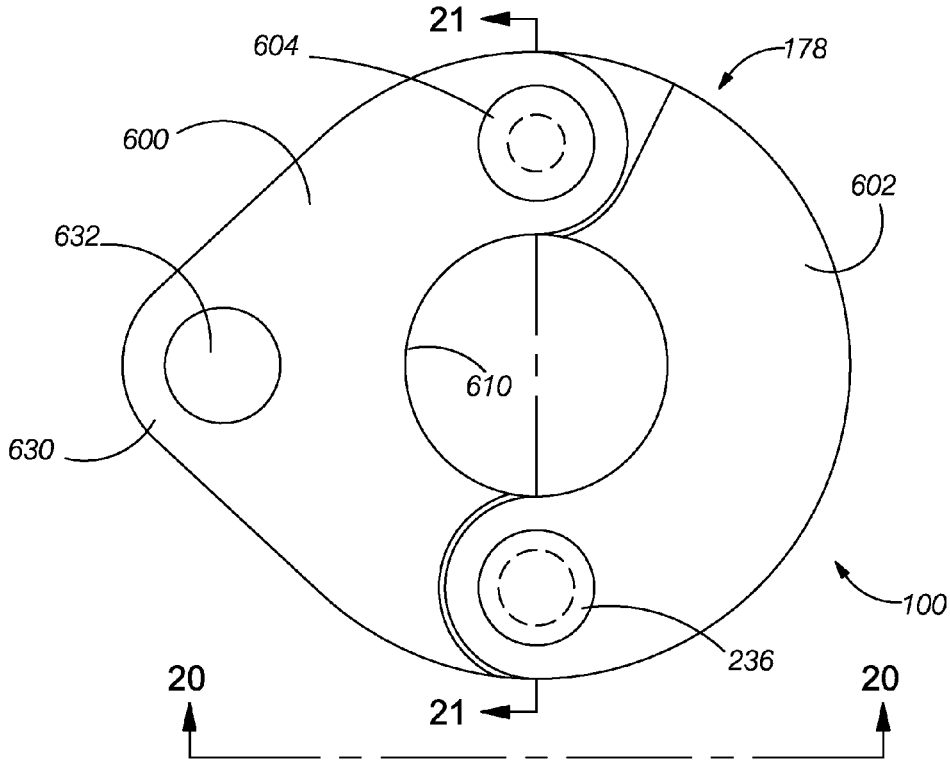
FIG. 19 illustrates a plan view of a cable guide ring for securing the lift cable to the tube section joint lock ring clamp of FIG. 14.
Figure 20:
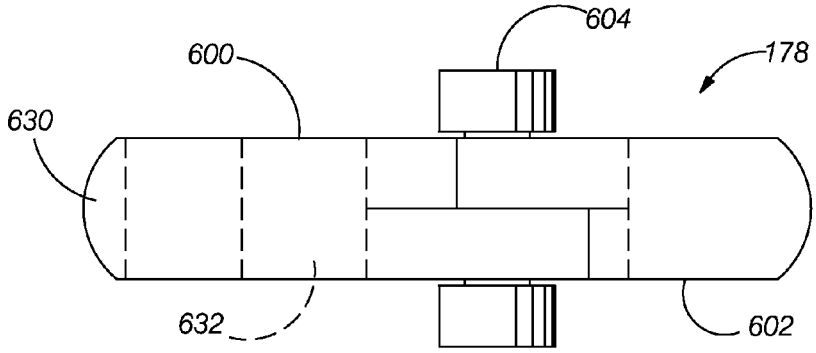
FIG. 20 illustrates an elevational view of the cable guide ring of FIG. 19 taken in the direction of the arrows 20-20 of FIG. 19.
Figure 21:
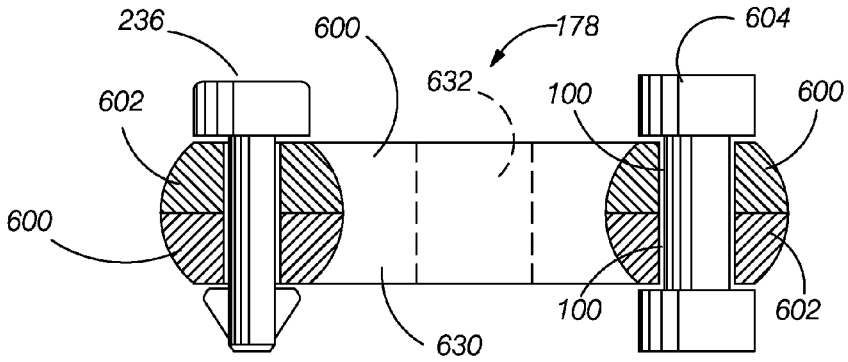
FIG. 21 illustrates a cross-sectional view of the cable guide ring of FIG. 19 taken along the line 21-21 of FIG. 19.

FIGS. 19-21 illustrate an embodiment of the cable guide ring 178 in more detail. In the illustrated embodiment, the cable guide ring is configured as a split ring comprising a first ring portion 600 and a second ring portion 602 that are pivoted by a pivot pin 604. The two ring portions have a combined inner circumference 610 that is sized to receive and loosely engage the outer diameter of the lift cable 160 described above. When the cable is inserted, the two ring portions are positioned with a respective first bore 620 in the first ring portion aligned with a respective second bore 622 in the second ring portion. A locking pin 236 with a selected diameter and length is inserted through the two bores to secure the cable. The first ring portion of the cable guide ring includes an enlarged portion 630 that surrounds a bore 632. The bore is sized to receive a locking pin so that the cable guide ring can be connected to the coupling system 154 as described above. The cable guide rings maintain the lift cable in a fixed position with respect to the tube sections 132, 140 so that the lift cable is maintained substantially parallel to the traverse guide cable 170 as the transfer tube string 130 and the collector assembly are lowered and raised. Accordingly, the cable guide rings assist in maintaining the transfer tube string in a substantially vertical position. The loose fit of the lift cable at each cable guide ring allows the lift cable to move with respect to the cable guide ring as the length of the cable changes in response to increased tension as more transfer tube sections are added to the transfer tube string and in response to temperature changes at different depths.

Figure 22:
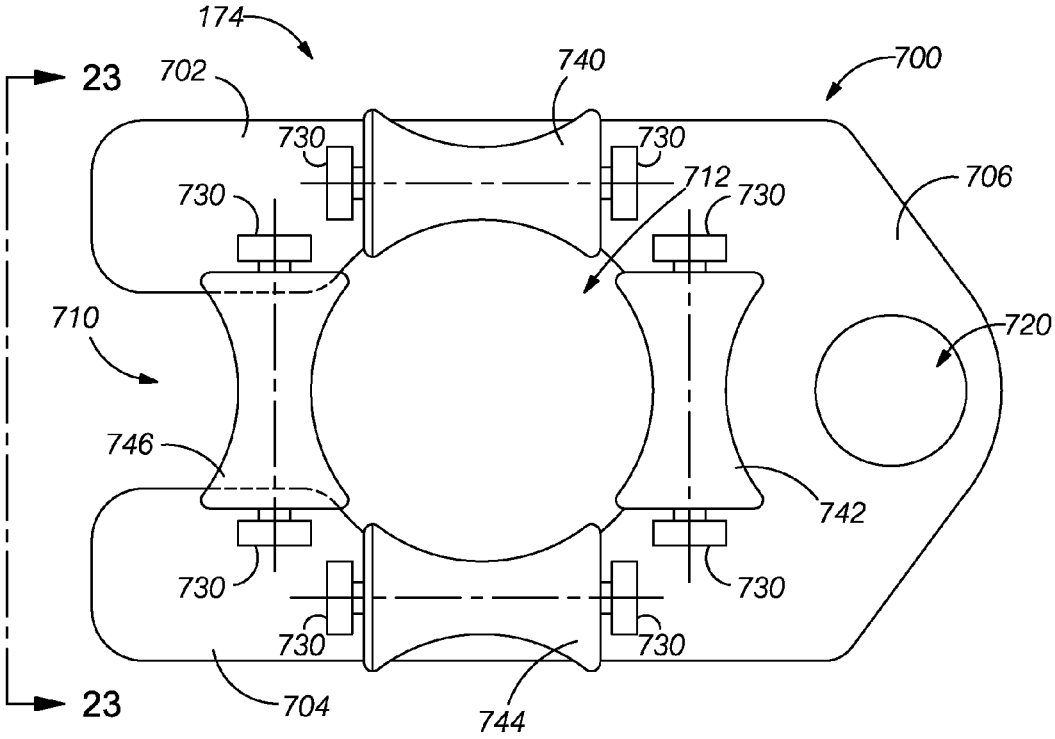
FIG. 22 illustrates a plan view of a roller guide assembly that guides each tube section along the anchored traverse guide cable.
Figure 23:
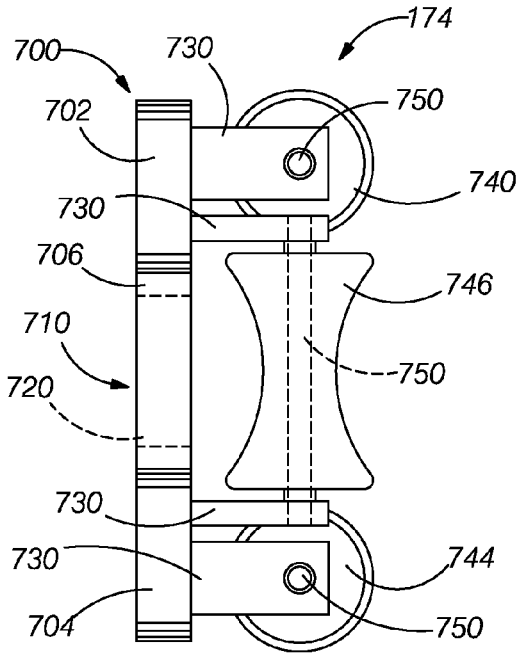
FIG. 23 illustrates an elevational view of the roller guide assembly of FIG. 22 taken in the direction of the arrows 23-23 in FIG. 22.

FIGS. 22 and 23 illustrate the roller guide assembly 174 in more detail. Each roller guide assembly comprises a base platform 700 that has a generalized horseshoe shape. In particular, the base platform comprises a first leg 702 and a second leg 702 that are connected at one end of the platform by an enlarged crosspiece 706. The opposite ends of the two legs are spaced apart by an open notch 710 that allows access to a central circular opening 712 that is sized to have a diameter that is slightly larger than the diameter of the traverse guide cable 170. The enlarged crosspiece has a bore 720 that is disposed opposite the notch. The bore is sized to receive a locking pin 236 of an appropriate length when the bore in the crosspiece is aligned with the bore 444 in the coupling system 154 to connect the roller guide assembly to the coupling system.

The base plate 700 of the roller guide assembly 174 supports a plurality of rollers on a corresponding plurality of roller supports 730. In the illustrated embodiment, a first roller 740 is positioned on the first leg 702 proximate to a first quadrant of the central circular opening 712. A second roller 742 is positioned on the crosspiece 706 proximate to a second quadrant of the central circular opening and oriented approximately orthogonally to the first roller. A third roller 744 is positioned on the second leg 704 proximate to a third quadrant of the central opening and oriented approximately orthogonally to the second roller and approximately parallel to the first roller. A fourth roller 746 is positioned between the first leg and the second leg and spans the notch 710. The fourth roller is approximately orthogonal to the first roller and the second roller and parallel to the second roller. In the illustrated embodiment, the four rollers are conventional "dog bone" rollers that are sized to accommodate the diameter of the traverse guide cable 170. The four rollers are disposed about the central circular opening with the arcuate centers of the roller surfaces spaced from the center of the central circular opening by as distance approximately equal to the radius of the traverse guide cable so that the traverse guide cable is maintained in the center of the central circular opening as the roller guide assembly is raised and lowered along the traverse guide cable.

As shown in the elevational view of the roller guide assembly 174 in FIG. 23, each roller is supported on the respective pair of roller supports 730 by a respective roller pin 750. The roller pin (shown in dashed lines) for the fourth roller 746 is removable to remove the fourth roller. When the fourth roller is removed, the notch 710 provides access to the central circular opening 712 so that the roller guide assembly can be attached to the traverse guide cable 170 by sliding the roller guide assembly onto the traverse guide cable until the traverse guide cable is substantially centered within the central circular opening. After positioning the roller guide assembly with respect to the traverse guide cable, the fourth roller is repositioned and secured by the respective roller pin to fully constrain the traverse guide cable within the central circular opening. A respective one of the roller guide assemblies is coupled to the traverse guide cable as each tube section 130, 140 is added to the top of the string 130 of tube sections.

As described herein, the collector assembly 120 and the string 130 of transfer tube sections 130, 140 of the oil recovery system 100 are quickly and easily installed over a leaking oil or gas well. In particular, coupling system 154 with the attached roller guide assembly 174 and attached cable guide ring 178 allows recovery personnel to add an additional transfer tube 132, 140 to the top of the transfer tube string, to couple the added transfer tube to the traverse guide cable 170 and to couple the added transfer tube to the lift cable 160 in one operation.

After the vertical transfer tube string 130 is completed and the flexible tube sections 144 are coupled to the uppermost transfer tube in the string, the oil recovery system 100 is ready for operation. The leaking fluid enters the collector assembly 120 and rises through the string of transfer tube sections (with the assistance of the pumps 142 in the active transfer sections 140 if needed) to the surface support vessel 110. The surface support vessel temporarily collects the oil and transfers the oil to a plurality of transfer shuttle tankers 112, which are replaced as needed to maintain a continual transfer until the leaking well can be repaired, plugged or bypassed to stop the leakage.

The oil recovery system 100 has an oil recovery capacity in excess of 1,000,000 barrels per day at a depth can vary from 100 feet to more than 2 miles. When the leakage at a site is stopped, the oil recovery system can be quickly dismantled by disconnecting the component devices as the devices are raised from the sea bed. The system is then available for use when needed at another leakage site.

Figure 24:
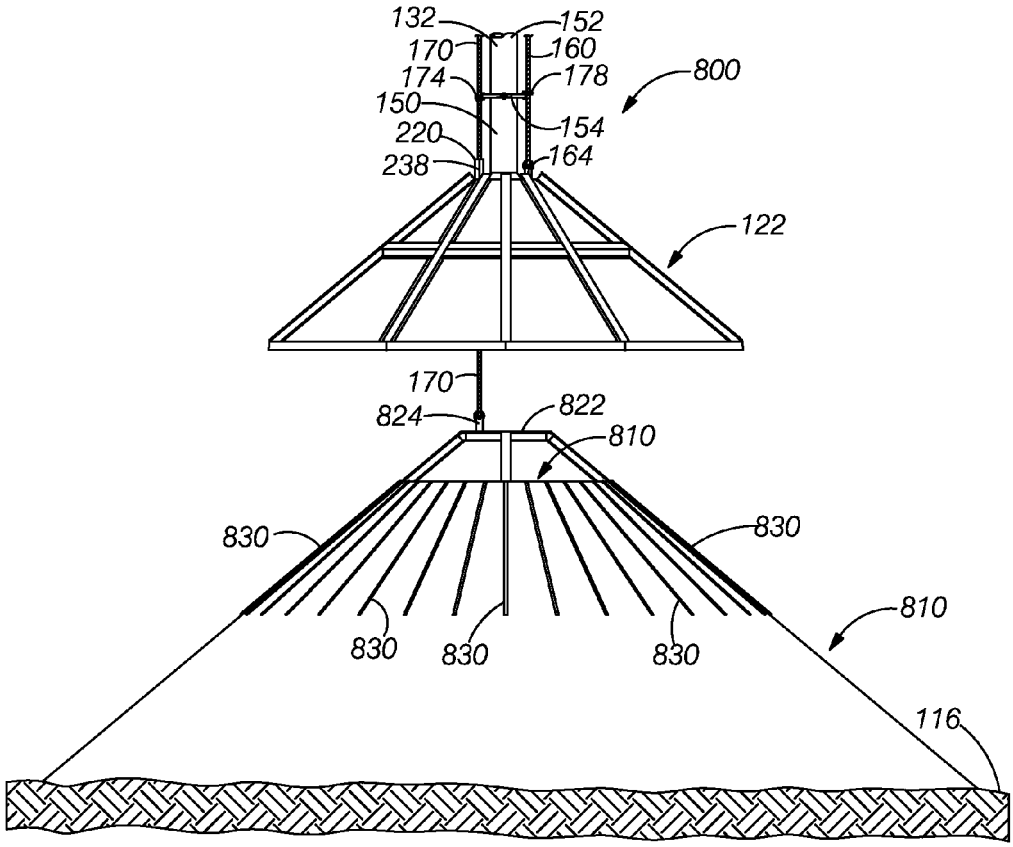
FIG. 24 illustrates an elevational view of an alternative embodiment of a collector assembly comprising a lower anchor portion that also functions as a first oil collection stage, and further comprising an upper collector portion corresponding to the upper collector portion of the embodiment of FIGS. 1-23, wherein the upper collector portion has not yet engaged the lower anchor portion.
Figure 25:
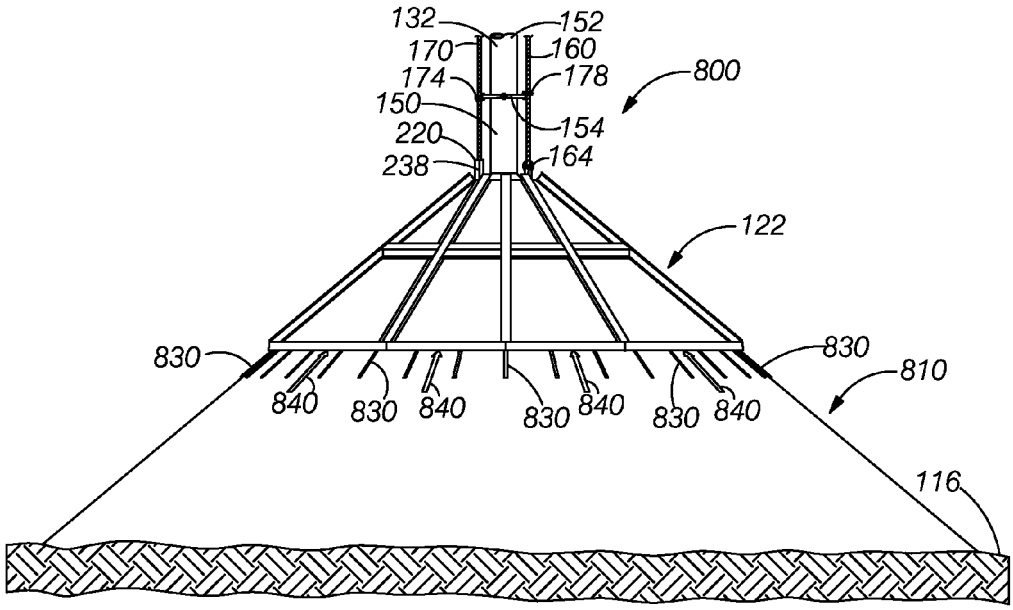
FIG. 25 illustrates the embodiment of FIG. 24 with the upper collector portion resting upon the lower anchor portion.

FIGS. 24 and 25 illustrate elevational views of an alternative embodiment of a collector assembly 800 comprising a lower anchor portion 810 that also functions as a first oil collection stage. The collector assembly further comprises the upper collector portion 122 described above in connection with the embodiment of FIGS. 1-23, and like elements are numbered accordingly. In the embodiment of FIGS. 24 and 25, the lift ring 164 is connected directly to the upper wall 128 (shown in FIG. 6) since the embodiment does not include the cylindrical rod of the other embodiment. In FIG. 24, the upper collector portion 122 has not yet engaged the lower anchor portion 810. In FIG. 25, the upper collector portion is positioned over the lower anchor portion as discussed in more detail below.

The lower anchor portion 810 of the collector assembly 800 of FIGS. 24 and 25 comprises an inverted funnel structure that has an outer wall that is sloped at approximately the same angle as the inner wall of the upper collector portion 122. The base of the lower anchor portion is larger than the base of the upper collector portion so that the lower anchor portion is substantially larger than the upper collector portion so that when the upper collector portion rests on the lower anchor portion, the base of the upper collector portion extends only part of the way down the outer wall of the lower anchor portion.

Preferably, the lower anchor portion 810 comprises concrete, structural steel or other suitable material to provide sufficient mass to serve as an anchor for the upper collector portion 122 and the transfer tube string 130 (described above). The lower anchor portion has a truncated top 820 that causes the lower anchor portion to have a large opening at the top. A support structure 822 comprising, for example, steel I-beams, is positioned proximate the truncated top and is secured to the lower anchor portion. A lifting ring 824 is attached to the support structure. The traverse guide cable 170 is attached to the lifting ring. The lower anchor portion is lowered to the sea bed via the traverse guide table and is positioned over the oil leak. The larger base of the lower anchor portion allows the lower anchor portion to encompass a larger leakage area than the upper collector portion. After positioning the lower anchor portion, the traverse guide cable remains attached to the lower anchor portion and is used to guide the upper collector portion and the transfer tube string toward the sea bed as described above.

An upper portion of the outer wall of the lower anchor portion 810 has a plurality of offset strips 830 positioned around the truncated top 820 and extending towards the base of the lower anchor portion. In the illustrated embodiment, the offset strips have a thickness of approximately 1 inch so that when the upper collector portion is lowered onto the lower anchor portion as shown in FIG. 25, the inner wall of the upper collector portion is separated from the outer wall of the lower anchor portion by a one-inch gap. Preferably, the offset strips have lengths selected so that the offset strips extend to at least to the base of the upper collector portion when the upper collector portion is resting on the lower anchor portion, as shown in FIG. 25.

When the lower anchor portion 810 is positioned over an oil leak at the sea bed 116, the oil collects within the lower anchor portion and then enters the upper collector portion 122 via the truncated top 820. The gaps between the lower anchor portion and the upper collector portion caused by the offset strips 830 allow sea water to enter into the upper collector portion as represented by a plurality of flow arrows 840. The water flow may enhance the oil flow through the transfer tube string 130 when the oil flow from the leak is low. The gap between the two portions is sufficiently small that any debris that enters the upper collector portion will be sufficiently small that the debris does not interfere with the oil recovery process. Thus, additional screening is not needed.

As various changes could be made in the above constructions without departing from the scope of the invention, it is intended that all the matter contained in the above description or shown in the accompanying drawings shall be interpreted as illustrative and not in a limiting sense.

What is claimed is:

1. An oil recovery system, comprising:

a fluid collector assembly positionable proximate to the bed of a body of water, the collector assembly having an open lower end to receive fluid and having an upper end coupled to a lowermost fluid transfer tube;

a plurality of rigid, substantially cylindrical fluid transfer tubes, each fluid transfer tube having a first coupling interface at a first end and having a second coupling interface at a second end;

a tube coupling system that interconnects the fluid transfer tubes as a string between the lowermost fluid transfer tube and the surface of the body of water, the tube coupling system comprising a plurality of tube coupling clamps, each tube coupling clamp interconnecting a respective first coupling interface of a respective one of the fluid transfer tubes to a respective second coupling interface of another of the fluid transfer tubes;

a guide system comprising a guide cable anchorable at the bed, the guide cable loosely coupled to the fluid collector assembly and to the fluid transfer tubes to maintain the guide cable generally in parallel to the fluid transfer tubes, the guide system guiding the fluid collector assembly and the fluid transfer tubes as the fluid collector assembly and the fluid transfer tubes are lowered to the bed; and a lifting system comprising a lift cable coupled to the fluid collector assembly to lower the fluid collector assembly and the fluid transfer tubes to the bed and to raise the fluid collector assembly and the fluid transfer tubes from the bed, the lift cable loosely coupled to the fluid transfer tubes to maintain the lift cable generally in parallel to the fluid transfer tubes.

2. The system as defined in claim 1, further including a plurality of buoyancy tanks, each buoyancy tank attached to at least one of the fluid transfer tubes to provide buoyancy to offset the weight of the fluid transfer tubes when the fluid transfer tubes and the buoyancy tanks are submerged in water.

3. The system as defined in claim 1, wherein the collector assembly includes a screen at the open lower end to inhibit debris and other solid material from entering the collector assembly.

4. The system as defined in claim 1, wherein selected fluid transfer tubes include an integral pump to aid the flow of fluid through the plurality of transfer tubes.

5. The system as defined in claim 1, wherein the tube coupling system also supports a cable guide ring to couple the tube coupling to the lift cable and a cable guide to couple the tube coupling to the guide cable.

6. The system as defined in claim 1, wherein the collector assembly includes a positioning device to maintain a lateral position of the collector assembly with respect to the bed of the body of water.

7. The system as defined in claim 1, wherein the fluid collector assembly comprises a lower anchor portion that gathers leaking fluid and comprises an upper collector portion that receives the fluid from the lower anchor portion and that delivers the fluid to the lowermost fluid transfer tube, the lower anchor portion being positioned on the bed of the body of water and being fixed to a lower end of the guide cable to anchor the guide cable, the upper collector portion being movable along the guide cable to enable the lift cable to position the upper collector portion vertically with respect to the lower anchor portion.

8. The system as defined in claim 1, wherein each fluid transfer tube comprises double wall tubing having a cavity between an inner wall and an outer wall, the cavity being filled with a fluid having a density less than the density of water to thereby provide buoyancy to the fluid transfer tube.

9. A method of recovering leaking fluid from a bed of a body of water, comprising:

positioning a fluid collector assembly proximate to the bed with an open lower end of the fluid collector assembly closer to the bed and with an upper end coupled to a lowermost fluid transfer tube;

interconnecting a plurality of rigid, substantially cylindrical fluid transfer tubes as a string between the lowermost fluid transfer tube and the surface of the body of water, the transfer tubes added serially to the top of the string as the fluid collector assembly is lowered toward the bed, each pair of transfer tubes interconnected by applying a coupling clamp to an upper face of a lower transfer tube of the pair and to a lower face of an upper transfer tube of the pair;

guiding the fluid collector assembly and the fluid transfer tubes to the bed along an anchored guide cable, the guide cable being coupled to the transfer tubes to maintain the guide cable generally in parallel to the transfer tubes;

lowering the fluid collector assembly and the fluid transfer tubes with a lift cable coupled to the fluid collector assembly until the fluid collector assembly is positioned a selected distance above the bed, the lift cable loosely coupled to the transfer tubes to maintain the lift cable generally in parallel with the transfer tubes; and transferring leaking fluid entering the lower end of the fluid collector assembly through the fluid transfer tubes to the surface.

10. The method as defined in claim 9, further comprising establishing a fixed lateral position of the fluid collector assembly with respect to the bed with a rod extending from the fluid collector assembly.

11. The method as defined in claim 9, wherein interconnecting the fluid transfer tubes comprises:

clamping flanges of adjacent fluid transfer tubes together with a tube clamping system;

positioning the guide cable in a guide assembly attached to the tube clamping system; and coupling the lift cable to the tube clamping system via a cable guide ring.

12. The method as defined in claim 9, further comprising positioning a screen over the open lower end of the fluid collector assembly to block debris from entering the fluid collector assembly.

13. The method as defined in claim 9, further comprising including a fluid transfer pump in at least one fluid transfer tube in the string of fluid transfer tubes.

14. The method as defined in claim 9, further comprising attaching a plurality of buoyancy devices to the string of fluid transfer tubes and submerging the buoyancy devices with the fluid transfer tubes to decrease the effective weight of the fluid transfer tubes when submerged in water.

15. The method as defined in claim 9, wherein each fluid transfer tube comprises double wall tubing having a cavity between an inner wall and an outer wall, the cavity being filled with a fluid having a density less than the density of water to thereby provide buoyancy to the fluid transfer tube.

* * * * *